US006247802B1

(12) United States Patent
Gasso

(10) Patent No.: US 6,247,802 B1
(45) Date of Patent: Jun. 19, 2001

(54) INK SUPPLY TUBE GUIDING SYSTEM FOR LARGE FORMAT PRINTER

(75) Inventor: Xavier Gasso, Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/240,091

(22) Filed: Jan. 29, 1999

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS

| | | | | |
|---|---|---|---|---|
| 3,102,770 | * | 9/1963 | McKeegan | 347/85 |
| 4,831,389 | | 5/1989 | Chan | 347/85 |
| 5,369,429 | | 11/1994 | Erickson | 347/7 |
| 5,469,201 | | 11/1995 | Erickson et al. | 347/85 |
| 5,489,931 | | 2/1996 | Shibata et al. | 347/85 |
| 5,650,811 | | 7/1997 | Seccombe et al. | 347/85 |
| 5,686,947 | | 11/1997 | Murray et al. | 347/85 |
| 6,003,981 | * | 12/1999 | Cameron et al. | 347/85 |

FOREIGN PATENT DOCUMENTS 97306158 3/1998 (EP) .

* cited by examiner

*Primary Examiner*—N. Le
*Assistant Examiner*—Anh T. N. Vo
(74) *Attorney, Agent, or Firm*—Roth & Goldman

(57) ABSTRACT

An ink supply tube guiding system for a large format inkjet printer includes front and rear oppositely facing tube guide channels each having a lower flange which supports the ink tubes which convey printer ink from stationary reservoirs to printheads mounted on a transversely movable printhead carriage. The tube guide channels provide support for the flexible ink supply tubes which are preferably bundled together in a vertically extending plane which has front and rear reaches of the tubes respectively supported by the front and rear channels and a reversed bend between the front and rear tube ridges which is self-supporting between the guide channels. The tube guide channels and ridges which support the guide channels on the printer frame provide a rigid structure in which the flexible ink tubes may be smoothly guided while minimizing wear of the flexible ink tubes.

32 Claims, 7 Drawing Sheets

40
42
46
50
52
54
56
58
70
72
74
76
130
132
134
8A
8A

INK SUPPLY TUBE GUIDING SYSTEM FOR LARGE FORMAT PRINTER

CROSS REFERENCE TO RELATED APPLICATIONS IF ANY

None.

BACKGROUND OF THE INVENTION AND PRIOR ART

The present invention relates to the art of computer driven printers, particularly, large format color ink jet printers. Printers of this type have a printhead carriage which is mounted for reciprocal movement on the printer in a direction orthogonal to the direction of movement of the paper or other medium on which printing is to take place through the printer. The printer carriage of a color printer typically has four removable electric or thermal ink jet pinheads mounted thereon. Each of the printheads contains a supply of ink which, for large scale printers, is generally inadequate due to the large volumes of ink which are required as compared with the ink supply requirements of desk top printers. Consequently, various means have been proposed for continuously or periodically refilling the carriage-borne printheads with ink. These systems fall into two categories. The first comprises offboard or off-axis ink reservoirs which are continuously connected to the carriage-borne or onboard printheads by flexible tubes. The second comprises a "take a gulp" system in which the printhead carriage is periodically moved to one end of its path of travel where it is then connected with off-axis ink reservoirs to fill the onboard printheads. This "take a gulp" system is disclosed in Hewlett-Packard's Designjet 2000 printer referred to in U.S. patent application Ser. No. 08/805,861 filed Mar. 3, 1997 and published in European Patent Publication No. 0863016 on Sept. 9, 1998.

Large format printers are expensive pieces of equipment which preferably should be capable of using different types of ink without significant modification of the printer. The different ink types may for convenience be broadly referred to as indoor ink and outdoor ink, meaning ink intended to be used for production of drawings, posters, and other printed material which may be displayed outdoors or indoors. Outdoor ink is pigment based, i.e. containing a plurality of discrete undissolved pigment particles suspended in a fluid carrier. Dye-based ink has a lower degree of optical density and permanence but is less expensive. Since pigment based inks and dye-based inks are incompatible with each other, a system is desired which enables the use of either type of ink in a printer without crosscontamination of the printer inks by each other.

Further, in color printers four separate colors of ink are usually employed composing black and three primary or mid-primary colors such as cyan, magenta and yellow. In color ink printers provision must also be made to ensure that neither incorrect types of ink nor incorrect colors of ink can inadvertently be used in the system.

Since the ink delivery tubes connected from offboard reservoirs to onboard printheads continually flex, leakage and breakage of the ink supply tubes is experienced. A reliable ink delivery system and guides for routing the ink delivery tubes to minimize flexing and breakage is desired.

SUMMARY OF THE INVENTION

The present invention provides an ink supply tube guiding system for a large format printer comprising:

a) a front tube guide having a generally vertically extending tube guide surface and a generally horizontally extending tube support surface;

b) a rear tube guide having a generally vertically extending tube guide surface and a generally horizontally extending tube support surface, said vertically extending surfaces of said guides being horizontally spaced and generally parallel to define a tube support and guide area therebetween, said tube support surfaces being aligned in a horizontal plane; and c) support structure for supporting said guides on a printer.

The present invention further provides a printer having a frame, a transversely moveable printhead carriage mounted for reciprocating movement on said frame, ink supply reservoir means mounted on said frame and an ink supply tube guiding system for delivering ink from said ink reservoir means to said printhead carriage, said guiding system comprising:

a) a front tube guide having a generally vertically extending tube guide surface and a generally horizontally extending tube support surface;

b) a rear tube guide having a generally vertically extending tube guide surface and a generally horizontally extending tube support surface, said vertically extending surfaces of said guides being horizontally spaced and generally parallel to define a tube support and guide area therebetween, said tube support surfaces being aligned in a horizontal plane;

c) support structure supporting said guides on said printer; and d) flexible ink guide tube means in fluid communication with said reservoir means and said printhead carriage, said guide tube means positioned on said support surfaces and confined for sliding movement between said guides and having a reverse bend located between said guides.

DESCRIPTION OF THE PREFERRED EMBODIMENT

Figure 1:
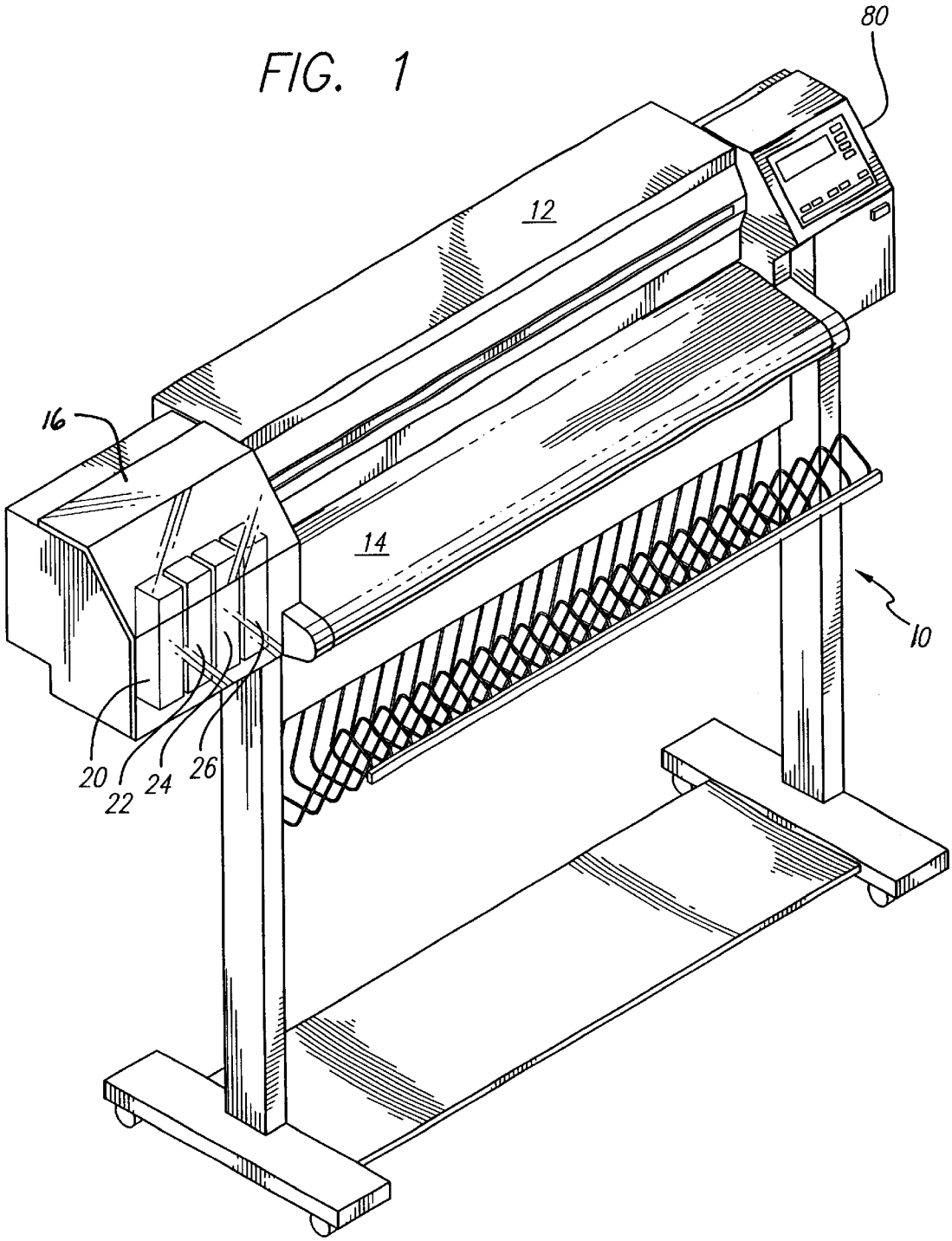
FIG. 1 is a perspective view of a large format printer in which the present invention is useful.

FIG. 1 shows a large format printer 10 of the type which includes a transversely movable printhead carriage enclosed by a plastic or metal hinged cover 12 which extends over a generally horizontally extending platen 14 over which printed media is discharged. At the left side of the platen is a transparent hinged cover 16 which contains four removable ink reservoirs 20, 22, 24, 26 which, through a flexible tube arrangement, supply ink to four inkjet printheads mounted on the moveable carriage.

Figure 2:
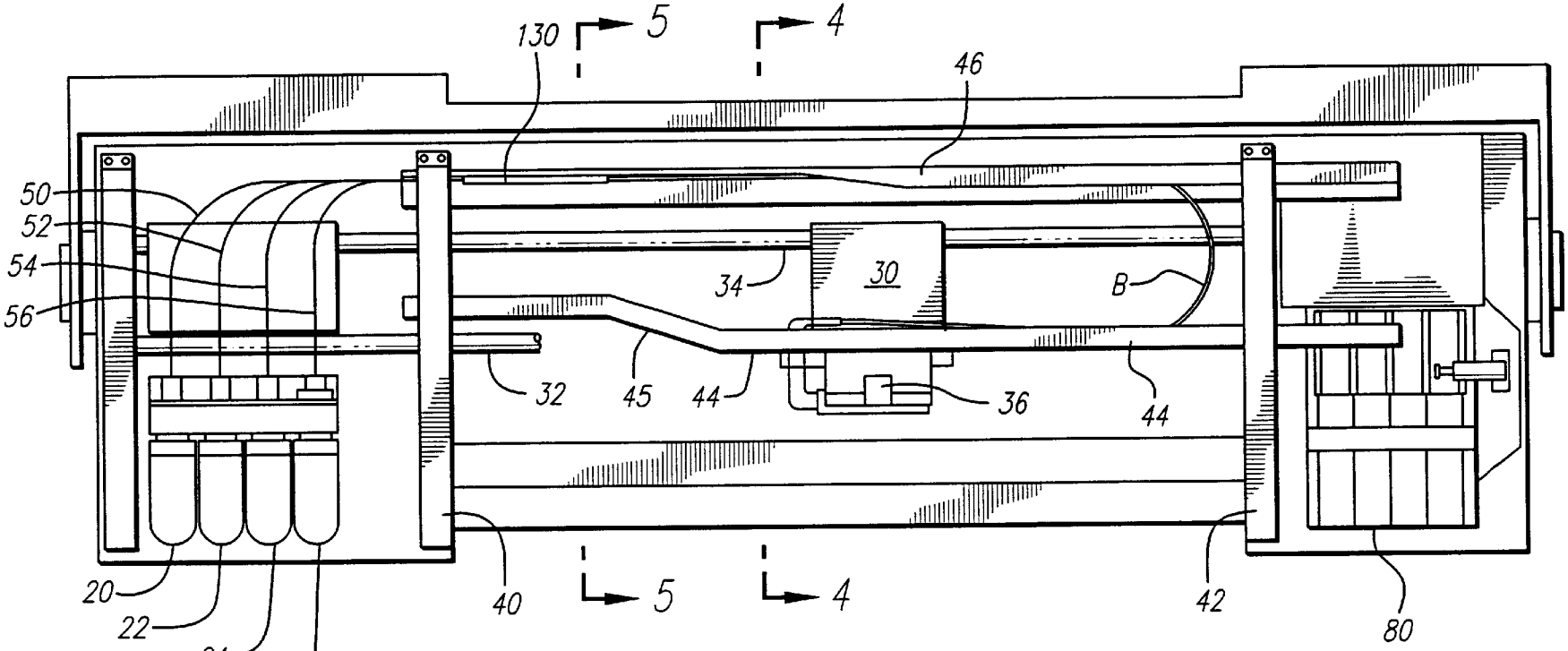
FIG. 2 is a top plan view of the printer with its cover removed to show the printhead carriage and ink tube guides and supports.

In the plan view of FIG. 2 in which the carriage cover 12 has been removed, it is seen that the printhead carriage 30 is mounted on a pair of transversely extending slider rods or guides 32, 34 which in turn are rigidly affixed to the frame of the printer. Also rigidly affixed to the frame of the printer are a pair of tube guide support bridges 40, 42 from which front and rear tube guides 44, 46 are suspended. The front tube guide 44 has end portions which extend transversely of the printer and an intermediate section 45 which is angled in a horizontal plane near the left bridge support 40 to provide a clearance area for opening a printhead holddown cover 36 on the carriage 30 when the carriage is slid to a position proximate the left side of the platen 14 so that the printhead holddown cover 36 can be easily opened for changing the printheads.

A flexible ink delivery tube system conveys ink from the four separate ink reservoirs 20, 22, 24, 26 at the left side of the printer through four flexible ink tubes 50, 52, 54, 56 which extend from an ink reservoirs through the rear and front tube guides 44, 46 to the carriage 30 to convey ink to four printheads on the carriage 30. The ink tube delivery system may be a replaceable system as described and claimed in co-pending application Ser. No. 09/240,039 filed Jan. 29, 1999 (HP 60980039) owned by the assignee of the present invention, the disclosure of which is hereby incorporated herein by reference.

At the right side of the printer is a printhead service station 80 at which the printhead carriage 30 may be parked for servicing such as wiping, spitting or priming the printheads.

Figure 3:
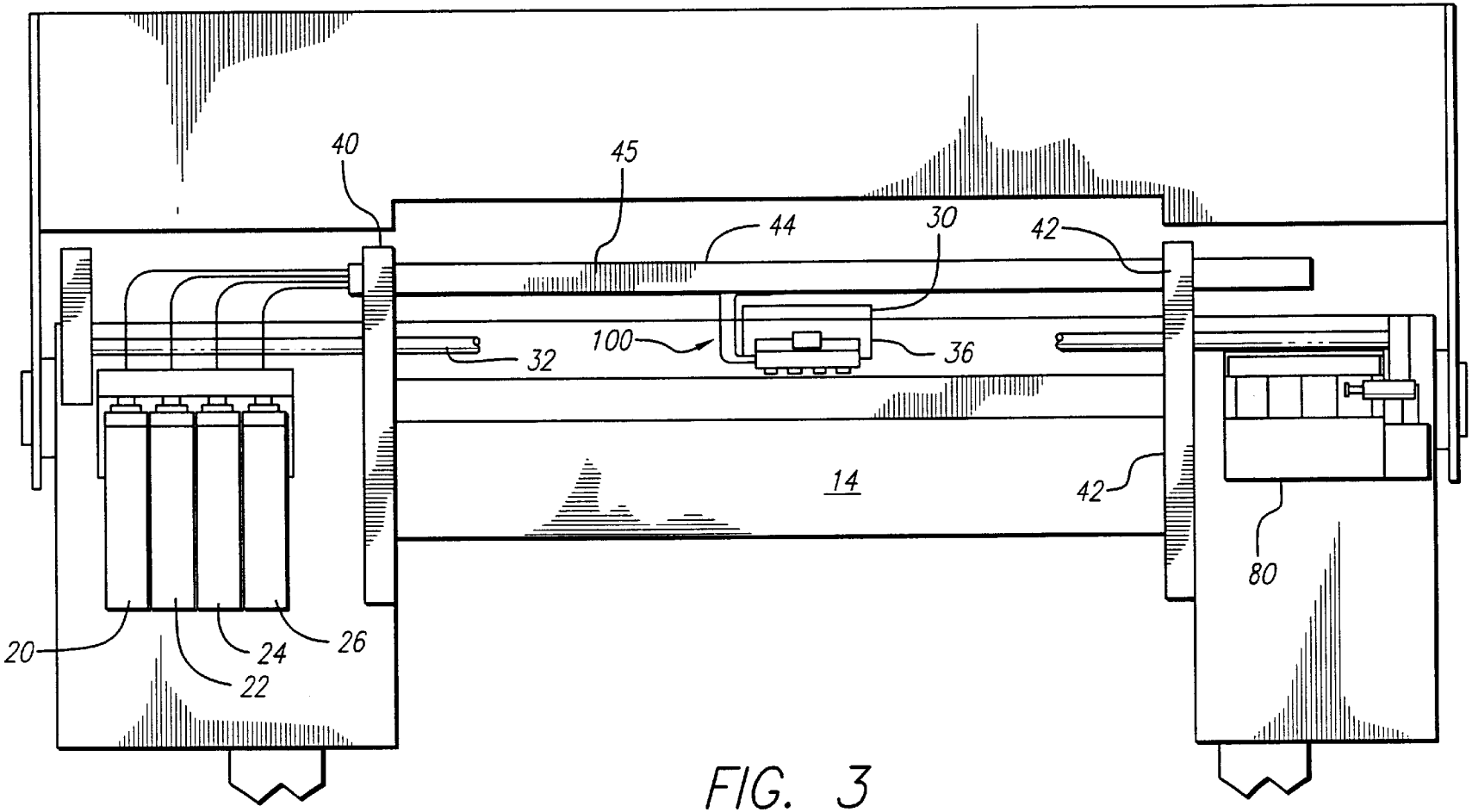
FIG. 3 is a front elevation view of the upper portion of the printer with cover removed to show the printhead carriage and attached printhead connector tubes.

As seen in FIG. 3, each of the four ink reservoirs 20, 22, 24, 26 is easily accessible from the front of the printer when the reservoir cover 16 (seen in FIG. 1) is open so that the reservoirs can be easily removed to be refilled or replaced with new reservoirs. As is known in the art, three of the reservoirs each contain a different base color of ink such as cyan, magenta and yellow and the fourth reservoir contains black ink so that a high number of colors can be produced as desired during printing.

Figure 4:
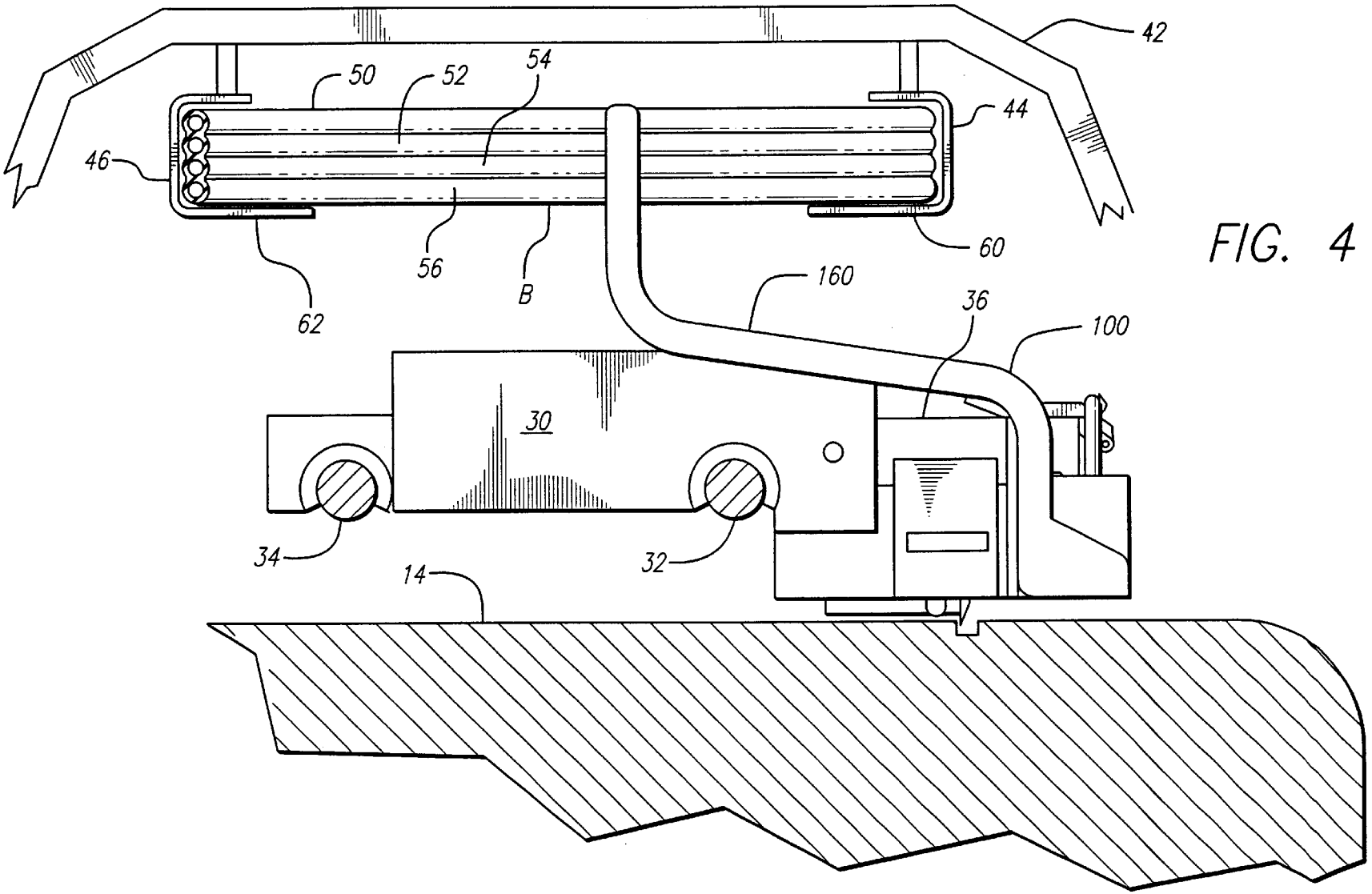
FIG. 4 is a vertical cross-section taken at line 4—4 on FIG. 3 through the relevant portions of the printer showing the relative position of the carriage, the tube guide system and the ink delivery tubes with a printhead holddown cover on the carriage in its closed position.
Figure 5:
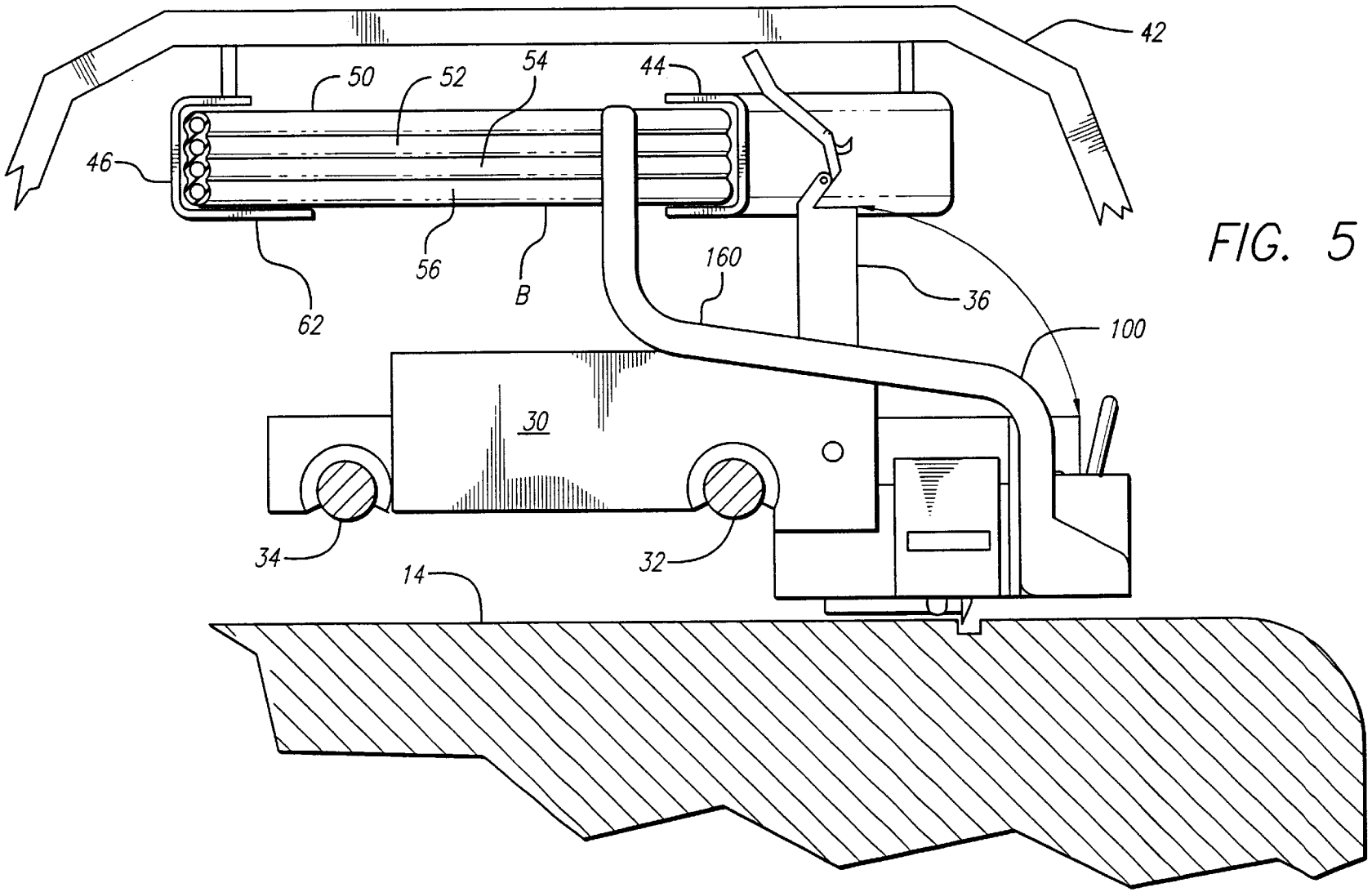
FIG. 5 is a vertical cross-section taken at line 5—5 on FIG. 3 through the relevant portions of the printer showing the relative position of the carriage, the tube guide system and the ink delivery tubes with the printhead holddown cover in its open or raised position.

As best seen in FIGS. 4 and 5, the front and rear tube guides 44, 46 are of channel configuration with each guide 44, 46 having a lower flange 60, 62 which provides a support surface which extends in a common horizontal plane for supporting the ink delivery tubes 50, 52, 54, 56 along its length with the exception of the reverse bend B (FIG. 2) in the tubes to the right of the printer carriage 30. The ink tubes are preferably bound together in a flexible wear resistant low friction sheath 58 to confine the tubes in a vertical plane and prevent wear as the tubes move in the guides 44, 46. The tube bundle and sheath is of sufficient rigidity to be self supporting in the region of the reverse bend B.

Figures 8A, 9:
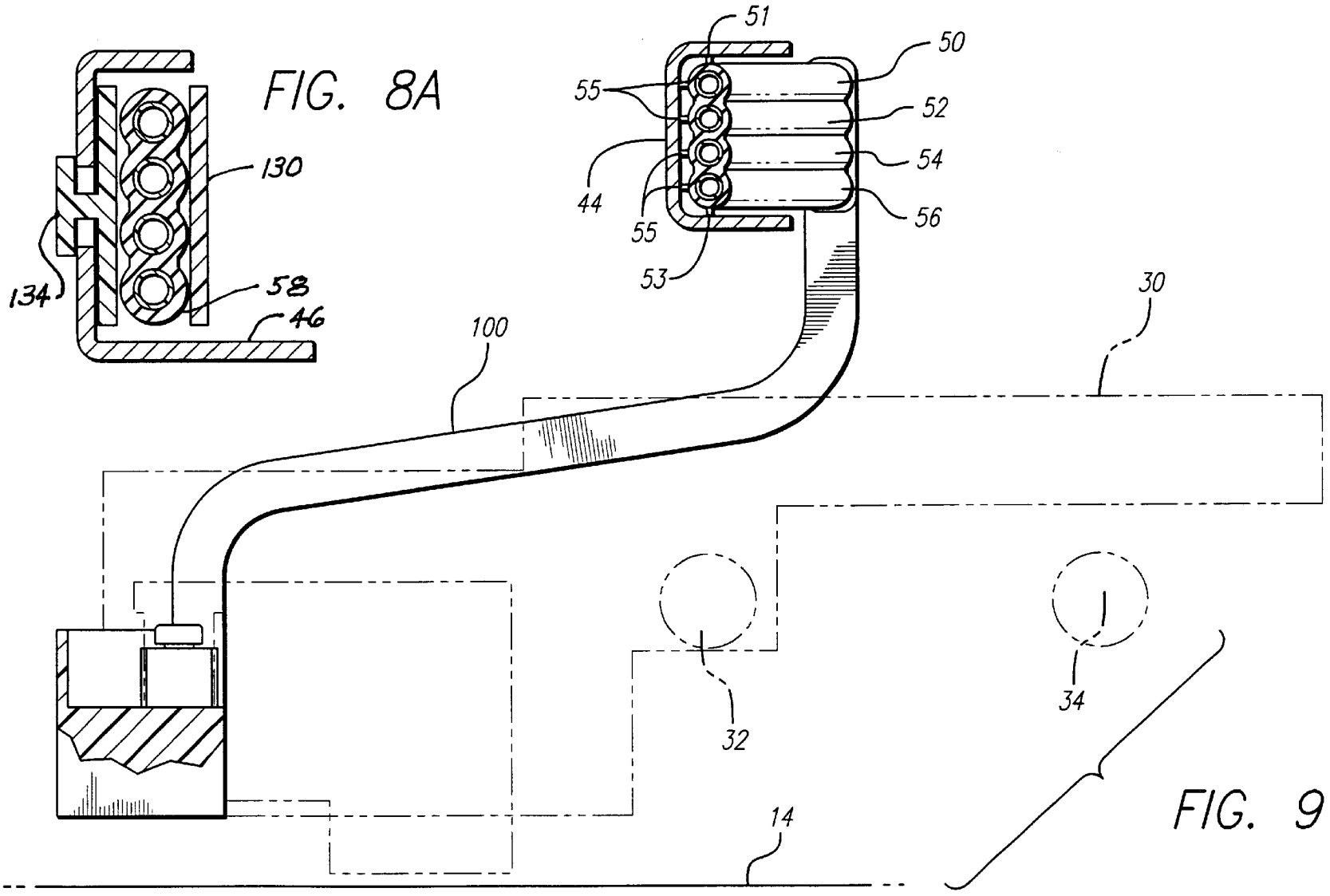
FIG. 9 is a right side elevation of a carriage connector and an ink tube support.

The flexible ink delivery tubes 50, 52, 54, 56 and sheath are all permanently connected to a printhead connector 100 which is a relatively rigid plastic part best seen in FIGS. 4 and 9. The ink delivery tubes are preferably made of a linear low density polyethylene. The protective sheath 58 encloses the flexible ink tubes between their permanent connection to the printhead connector 100 and a rigid plastic tube clip 130 which fastens the ink tubes to the rear tube guide 46 at the location shown in FIG. 2 near the left side of the printer. The protective sheath 58 preferably includes wear resistant lubricious ribs 51, 53 on the top of the upper tube 50 and on the bottom of the lower tube 56 and ribs 55 on the sides of all four tubes 50, 52, 54, 56 which face the front and rear tube guides 44, 46. The ribs 51, 53, 55 are preferably made from polypropylene containing about 5% aramid fibers and 20% polytetrafluoroethuylene (MFLON). The material of the sheath 58 is preferably a polypropylene and EPOM compound which is both flexible and fatigue resistant. The above combination of materials for the sheath and ribs has been found to be considerably more quiet than prior art flexible ink delivery systems.

Apertures 70, 72 having elongated slots 74, 76 in the vertical wall of the rear tube guide 46 receive mating bayonet clips 132, 134 on the rear side of the tube clip 130 so that the tube clip may be slid to the right or the left to easily connect or disconnect the clip 130 from the rear tube guide 46.

The lower tube support flange 60 of the front tube guide 44 is shown in a generally horizontal plane in FIG. 4 but a slight downward inclination of the flange toward the opposite flange 62 of the rear tube guide 46 is desirable to assist in smooth movement of the tube bundle in the front guide. Comparison of FIGS. 4 and 5 shows that the lower flange 60 is slightly downwardly inclined in the FIG. 4 view but is somewhat horizontally shorter and is horizontally oriented in the FIG. 5 view. Reduction in the horizontal length of the support flange 60 as seen in FIG. 5 enables the printhead connector 100 and attached tubes to pass to the side of the flange 60 in the region of the left transversely extending section of the front tube guide 44. Also as seen in FIGS. 2, 4 and 5, the rear tube guide has an upper flange which extends substantially along the right half of the rear tube guide 46, the top flange gradually terminating at an angled section centrally located on the printer. It will be appreciated that there is no relative motion between the rear tube guide and the tubes in the section which is uncovered by the top flange. Similarly, the short section of tubes and sheath extending from the permanent connection to the printhead connector 100 to the lower flange 60 of the front tube guide 44 need not be supported by the lower flange 60 since the tubes and sheath are self supporting for short lengths in this area and at the reverse bend B of the tubes.

Figures 6, 7, 8:
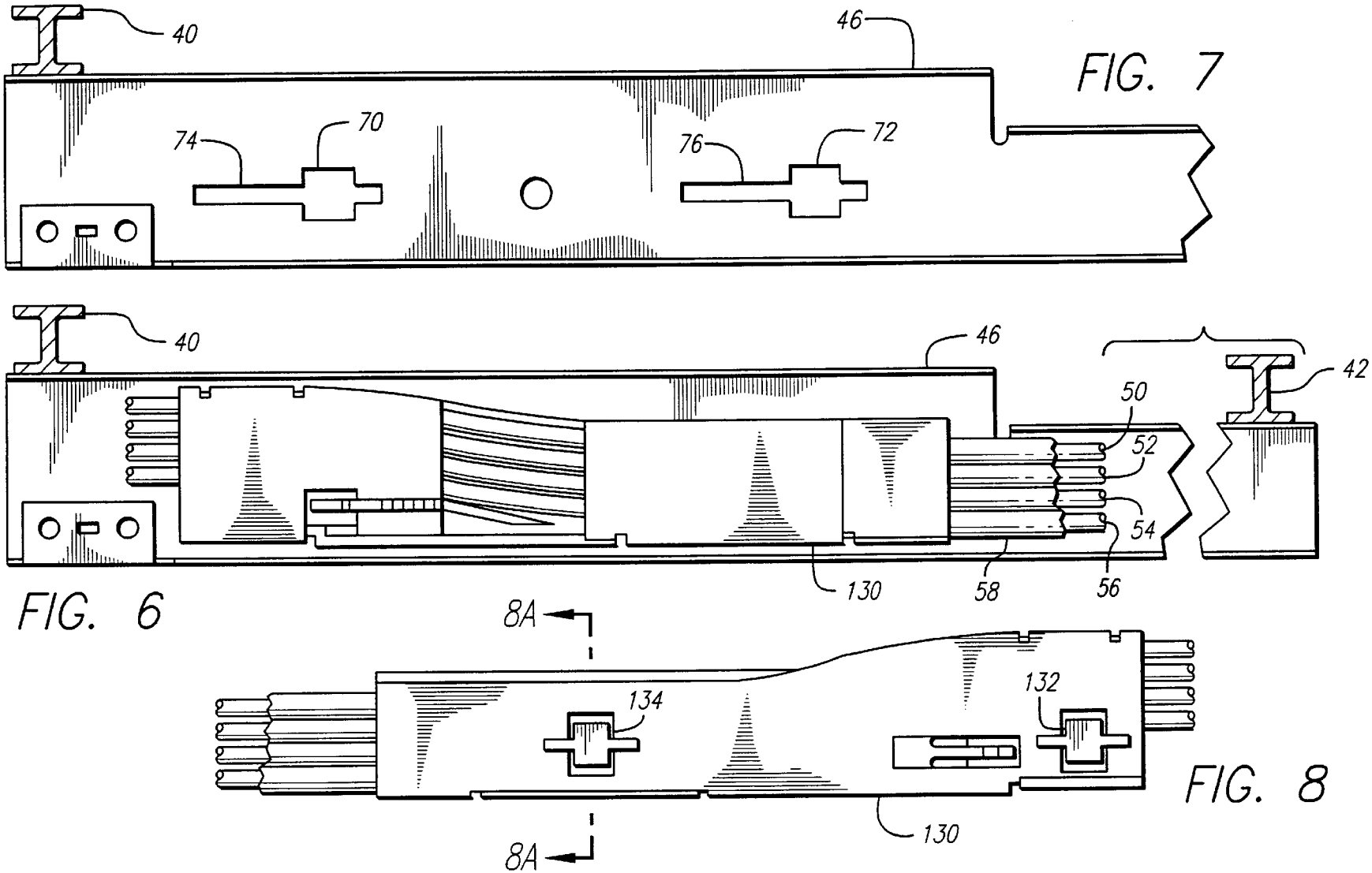
FIG. 6 is a partial front elevation of the rear tube guide and a tube clip partly broken away to show internal construction, fastening the ink tubes to the rear tube guide.
FIG. 7 is a partial front elevation view of the rear tube guide with the tube clip and tubes removed.
FIG. 8 is a rear elevation view of the tube clip, FIG. 8A being an enlarged cross-section at line 8A—8A of FIG. 8.

An ink tube clip 130 (FIGS. 6–8) comprises a molded plastic part having four parallel tube channels formed therein. The sheath terminates near the right end of the tube guide 130 and the four ink delivery tubes 50, 52, 54, 56 extend continuously through the channels in the guide 130 to emerge from the left edge of the guide. The guide is provided with foldable upper and lower closure flaps integrally formed with the rear channel-defining wall of the clip 130 and are connected thereto by flexible hinge sections and connectors having inherent resilience so that the doors may be closed over the ink delivery tubes and sheath, the tubes being confined in their respective channels. A resilient hook in the rear wall of the clip 130 engages an aperture in the upper flap to close the flap over the ink delivery tubes. An engagement lip at the lower edge of the rear wall of the clip 130 mates with a complementary hook on the lower edge of the upper flap to securely fasten the flap head hold and hold the tubes in place. A front flap is similarly constructed with a flexible hinge joining it to the channel defining wall of the clip 130. Complementary hooks on the upper right edge of the channel defining wall of the clip 130 and upper edge of the lower flap securely hold the flap in place to confine the tubes and sheath at the right end of the clip 130.

The rear side of the clip has integrally molded fasteners thereon which are received in complementary shaped slotted apertures in the vertically extending wall of the rear tube guide as shown.

Persons skilled in the art will understand that various modifications of the preferred embodiment can be made without departing from the scope of the invention which is defined by the appended claims. For example, the opposed front and rear tube guides 44, 46 may be tilted slightly from the positions shown in the drawings such that the generally vertically extending tube guide surfaces and the generally horizontally extending tube support surfaces are not positioned in strictly vertical and horizontal planes.

What is claimed is:

1. An ink supply tube guiding system for a large format printer comprising:

a) a front tube guide having a generally vertically extending tube guide surface and a generally horizontally extending tube support surface;

b) a rear tube guide having a generally vertically extending tube guide surface and a generally horizontally extending tube support surface, said generally vertically extending surfaces of said front and rear tube guides being horizontally spaced and generally parallel to define a tube support and guide area therebetween, said tube support surfaces being generally aligned in a horizontal plane; and c) support structure connected to said guides for supporting said guides in a stationary position on a printer.

2. The guiding system of claim 1, wherein said front and rear tube guides further comprise generally horizontally extending upper tube guide surfaces extending toward each other from said vertically extending guide surfaces above said tube guide area.

3. The guiding system of claim 2, wherein said front and rear tube guides comprise oppositely facing guide channel members.

4. The guiding system of claim 3, wherein said support structure comprises spaced bridge supports, said channel members being suspended from said bridge supports on said printer above and rearwardly from the path of movement of a printhead carriage.

5. The guiding system of claim 4, wherein said front tube guide channel member is angled rearwardly proximate one end of the printer to provide a clearance area for accessing a printhead carriage.

6. The guiding system of claim 4, wherein said tube support surface of said front tube guide comprises a lower flange of said channel member, said flange being inclined slightly downwardly toward said rear tube guide.

7. A printer having a frame, a transversely moveable printhead carriage mounted for reciprocating movement on said frame, ink supply reservoir means mounted on said frame and flexible ink supply tube means for delivering ink from said ink reservoir means to said printhead carriage, said printer further comprising an ink tube guiding system comprising:

a) a front tube guide having a generally vertically extending tube guide surface and a generally horizontally extending tube support surface;

b) a rear tube guide having a generally vertically extending tube guide surface and a generally horizontally extending tube support surface, said vertically extending surfaces of said front and said rear tube guides being horizontally spaced and generally parallel to define a tube support and guide area therebetween, said tube support surfaces being aligned in a horizontal plane; and c) support structure connected to said guides and to said printer supporting said guides in a stationary position on said printer; said flexible ink tube means having substantially parallel front and rear reaches positioned on said support surfaces and confined for sliding movement between said guides and having a reverse bend between said front and rear reaches located between said guides, and wherein said tube means comprises a plurality of tubes extending in parallel to each other, and a protective sheath containing said tubes along at least a portion of their length from said rear tube guide through said reverse bend to said front tube guide.

8. The printer of claim 7, wherein said reverse bend is self-supporting between said front and rear reaches.

9. The printer of claim 8, wherein said front and rear tube guides comprise oppositely facing guide channel members.

10. The printer of claim 9, wherein said support structure comprises spaced bridge supports, said channel members being suspended from said bridge supports on said printer above a path along which said printhead carriage moves.

11. The printer of claim 10, wherein said front tube guide channel member is angled rearwardly proximate one end of said printer to provide a clearance area for accessing said printhead carriage.

12. The printer of claim 11, wherein said tube support surface of said front tube guide comprises a lower flange of said channel, said flange being inclined slightly downwardly toward said rear tube guide.

13. The printer of claim 7, further comprising a printhead connector which is more rigid than said tube means permanently attached to said tube means and attached to said carriage.

14. The printer of claim 13, wherein said printhead connector includes a rigid arm comprising a tube guide for smoothly guiding said tube means without kinking from a first direction extending generally parallel to the direction of movement of said carriage downwardly and transversely toward the front of said printer alongside and across the path of movement of said carriage through a second direction opposite to said first direction and said tube means terminate in generally vertical direction.

15. The printer of claim 14, wherein said tube means and said sheath are arranged in a generally vertically extending plane.

16. The printer of claim 15, wherein said tube means comprises four tubes.

17. The printer of claim 16, further comprising a clip affixing a stationary region of said tubes and said sheath to said rear tube guide.

18. The printer of claim 16, wherein said flexible tubes are made of low density polyethylene.

19. The printer of claim 16, further comprising lubricious wear resistant ribs on areas of said sheath which contact said tube guides.

20. The printer of claim 19, wherein said protective sheath is made of a polypropylene and EPDM compound and said ribs are made of polypropylene containing about 5% aramid fibers and about 20% polytetrafluoroethylene.

21. An ink supply tube guiding system for a large format printer comprising:

a) a first tube guide having a tube guide surface and a tube support surface;

b) a second tube guide having a tube guide surface and a tube support surface, said tube guide surfaces of said first and second tube guides being spaced and generally parallel to define a tube support and guide area therebetween; and c) support structure connected to said guides for supporting said guides in a stationary position on a printer.

22. The guiding system of claim 21, wherein said first and said second tube guides comprise front and rear tube guides, said tube support surfaces being generally horizontally oriented and said tube guide surfaces being generally vertically oriented, said guides further including generally horizontally extending upper tube guide surfaces extending toward each other from said vertically extending guide surfaces above said tube guide area.

23. The guiding system of claim 22, wherein said front and rear tube guides comprise oppositely facing guide channel members.

24. The guiding system of claim 23, wherein said support structure comprises spaced bridge supports, said channel members being suspended from said bridge supports on a printer above and rearwardly from the path of movement of a printhead carriage.

25. The guiding system of claim 24, wherein said front tube guide channel member is angled rearwardly proximate one end of the printer to provide a clearance area for accessing a printhead carriage.

26. The guiding system of claim 25, wherein said tube support surface of said front tube guide comprises a lower flange of said channel, said flange being inclined slightly downwardly toward said rear tube guide.

27. A printer having a frame, a transversely moveable printhead carriage mounted for reciprocating movement on said frame, ink supply reservoir means mounted on said frame and flexible ink supply tube means for delivering ink from said ink reservoir means to said printhead carriage, said printer further comprising an ink tube guiding system comprising:

a) a first tube guide having a tube guide surface and a tube support surface;

b) a second tube guide having a tube guide surface and a tube support surface, said tube guide surfaces of said guides being spaced and generally parallel to define a tube support and guide area therebetween, said tube support surfaces being aligned in a plane; and c) support structure supporting said guides in a stationary position on said printer;

said flexible ink tube means having substantially parallel reaches positioned on said support surfaces and confined for sliding movement between said guides and having a reverse bend between said reaches located between said guides.

28. The printer of claim 27, wherein said reverse bend is self-supporting between said front and rear reaches.

29. The printer of claim 28, wherein said front and rear tube guides comprise oppositely facing guide channel members.

30. The printer of claim 29, wherein said support structure comprises spaced bridge supports, said channel members being suspended from said bridge supports on said printer above the path of movement of said printhead carriage.

31. The printer of claim 30, wherein said front tube guide channel member is angled rearwardly proximate one end of said printer to provide a clearance area for accessing said printhead carriage.

32. The printer of claim 31, wherein said tube support surface of said front tube guide comprises a lower flange of said channel, said flange being inclined slightly downwardly toward said rear tube guide.

* * * * *